US006882215B1

(12) United States Patent
Lee

(10) Patent No.: US 6,882,215 B1
(45) Date of Patent: Apr. 19, 2005

(54) SUBSTRATE BIAS GENERATOR IN SEMICONDUCTOR MEMORY DEVICE

(75) Inventor: Hee-Chun Lee, Seoul (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 08/825,582

(22) Filed: Mar. 31, 1997

Related U.S. Application Data

(63) Continuation of application No. 08/691,822, filed on Aug. 5, 1996, now abandoned, which is a continuation of application No. 08/596,423, filed on Feb. 2, 1996, now abandoned, which is a continuation of application No. 08/376,347, filed on Jan. 23, 1995, now abandoned.

(30) Foreign Application Priority Data

Jan. 21, 1994 (KR) ..... 1994-1124
Jul. 14, 1996 (KR) ..... 1993-13276

(51) Int. Cl.[7] ..... G05F 1/10
(52) U.S. Cl. ..... 327/536; 327/537; 365/226
(58) Field of Search ..... 327/77, 78, 80, 327/534, 535, 536, 537; 365/226

(56) References Cited

U.S. PATENT DOCUMENTS 4,401,897 A * 8/1983 Martino, Jr. et al. ..... 327/537
4,794,278 A * 12/1988 Vajdic ..... 327/537
4,964,082 A * 10/1990 Sato et al. ..... 327/534
5,157,278 A 10/1992 Min et al.
5,191,235 A * 3/1993 Hara ..... 327/534
5,270,584 A * 12/1993 Koshikawa et al. ..... 327/534
5,329,168 A * 7/1994 Sugibayashi et al. ..... 327/535
5,376,840 A * 12/1994 Nakayama ..... 327/537
5,394,026 A * 2/1995 Yu et al. ..... 327/537

OTHER PUBLICATIONS

*Low Power Self Refresh Mode With Temperature Detecting Circuit,* 1993 Symposium on VLSI Circuits, pp. 43–44, Kagenishi et al.

Full English Translation of Korean Application No. 13276 (23 pages text, 8 pages drawing)(Jul. 1993).

* cited by examiner

*Primary Examiner*—Terry D. Cunningham
(74) *Attorney, Agent, or Firm*—Lee & Sterba, P.C.

(57) ABSTRACT

A substrate bias generator which makes device characteristics stable by supplying a predetermined negative voltage to a substrate and minimally reduces current consumption during a self refresh mode. The substrate bias generator comprises a substrate voltage level detector for inputting a substrate voltage and outputting a signal which drives an oscillator in response to the input level, and a controller for inputting a chip active enable signal, a self refresh mode enable signal and an output signal of the substrate voltage level detector and controlling a switching operation of the substrate voltage level detector in response to the input level.

7 Claims, 3 Drawing Sheets

SUBSTRATE BIAS GENERATOR IN SEMICONDUCTOR MEMORY DEVICE

This is a continuation of appln. Ser. No. 08/691,822; filed Aug. 5, 1996, abandoned upon the filing hereof; which is a continuation of appln. Ser. No. 08/596,423; filed Feb. 2, 1996 (abandoned); which is a continuation of appln. Ser. No. B08/376,347; filed Jan. 23, 1995 (abandoned).

BACKGROUND OF THE INVENTION

The present invention relates to a semiconductor memory device, and more particularly to a substrate bias generator which makes device characteristics stable by supplying a predetermined negative voltage to a substrate and minimally reduces current consumption during a self refresh mode.

In general, a P-type substrate is employed in a dynamic RAM having a memory cell which is composed of one access transistor and one storage capacitor. Further, it is well known that a substrate bias generator must be included in the use of the P-type substrate, the substrate bias generator supplying a negative voltage of a predetermined level to the substrate. In the meantime, the substrate bias generator is installed in inside of a chip and the negative voltage is thus provided to the substrate because there are the following some advantages, compared with a case of connecting the substrate to a ground terminal GND. First, it is possible to minimize variation of a threshold voltage generated by body effect of a transistor and it is possible to obtain efficiency of operational speed by making a punch-through voltage high and by reducing a junction capacitance. Second, in order to protect the memory device, it is possible to suppress forward-bias by reducing sub-threshold current and by undershooting an input voltage of TTL(Transistor-Transistor Logic) input stage. According to the above advantages, if the constant negative voltage is provided to the substrate by the substrate voltage generator, the function of the memory device is generally improved.

In the meantime, the substrate bias generator of which driving capacity is improved is disclosed in U.S. Pat. No. 5,157,278 entitled "Substrate Voltage Generator for Semiconductor Device" granted on 20 Oct. 1992. FIG. 1 is a schematic block view showing a substrate bias generator disclosed in the above U.S. Pat. No. 5,157,278. FIG. 1 is composed of a voltage pump circuit 6 providing a substrate voltage VBB, a substrate voltage level detector 10 detecting the voltage level of the substrate voltage VBB, a signal delay circuit 2 delaying an output signal of the substrate voltage level detector 10 during a predetermined time and thereby generating the output signal, and an oscillator 4 performing an oscillating operation in response to the output signal of the signal delay circuit 2 and driving the voltage pump circuit 6. In such a construction, if the oscillator 4 is operated, the substrate voltage VBB is synchronized with an oscillating signal ϕOSC generated in the oscillator 4 and is boosted to a predetermined negative voltage by the voltage pumping operation of the voltage pump circuit 6. In the meantime, the substrate voltage level detector 10 shown in a dotted line block, includes a PMOS transistor 12 having a channel formed between a power supply terminal Vcc and a connecting node 14 and being always apt to be turned on, a PMOS transistor 16 whose source terminal is connected to the connecting node 14 and whose gate terminal is connected to the substrate voltage VBB, an NMOS transistor 18 having the channel formed between the PMOS transistor 16 and a ground terminal Vss and being always apt to be turned on, and an inverter 20 having an input terminal coupled to the connecting node 14 and driving the signal delay circuit 2. The substrate voltage level detector 10 detects the level of the substrate voltage VBB and controls the oscillator 4 in response to such a detecting operation. Therefore, in case that the voltage level of the substrate voltage VBB is over a desired negative voltage level (in this case, an absolute value of the substrate voltage VBB is small), the substrate voltage VBB is boosted to the desired negative voltage level by generating a signal to enable the oscillator 4 and by operating the oscillator 4. On the other hand, in case that the voltage level of the substrate voltage VBB is below the desired negative voltage level (in this case, the absolute value of the substrate voltage VBB is large), the substrate voltage VBB is continuously maintained at the desired negative voltage level by generating the signal to enable the oscillator 4 and by stopping the operation of the oscillator 4. The signal delay circuit 2 receiving the output signal of the substrate voltage level detector 10, prevents the voltage level of the substrate voltage VBB being sensitively varied and thereby makes the operation of the substrate bias generator stable.

In the construction of the substrate voltage level detector 10 detecting the voltage level of the substrate voltage VBB, the PMOS transistor 16 is switch-controlled by the substrate voltage VBB according to a gate-input of the substrate voltage VBB. Accordingly, if the voltage level of the substrate voltage VBB becomes high, the voltage level charged to the connecting node 14 is raised. The inverter 20 is output at the "low" level. In this case, the oscillator 4 is enabled. On the other hand, if the voltage level of the substrate voltage VBB becomes low, the voltage level charged to the connecting node 14 is dropped. The inverter 20 is output at the "high" level. In this case, the oscillator 4 is disabled. The substrate voltage VBB softly or heavily turns on the channel of the PMOS transistor 16, however, it can completely not turn off the channel thereof. Therefore, the PMOS transistors 12 and 14 and the NMOS transistor 18 are always turned-on, so that direct current flows between the power supply terminal Vcc and the ground terminal Vss. Further, the voltage level charged to the connecting node 14 is set near a trip point of the inverter 20, so that the other direct current flows between the power supply terminal Vcc and the ground terminal Vss in the inverter 20(this is generally composed of a CMOS inverter). Therefore, the current of the substrate voltage level detector 10 always flows in case of powering-up of the chip regardless of the operation of the semiconductor memory device. This specially causes the consumption of the operational current to be increased during a stand-by state.

In the meantime, in case of the cell which has the dynamic construction such a dynamic RAM, it is well known that a refresh mode is included as one operational mode in the semiconductor memory device so as to perform a rewrite operation of cell storage data. In special, a self refresh mode is generally employed in the semiconductor memory device, the self refresh mode performing a refresh operation according to an interval of constant time. The dynamic RAM performing low current consumption during the self refresh mode, is disclosed in pages 43 to 44 of a paper from "1993 Symposium on VLSI circuits, entitled "Low power Self Refresh Mode With Temperature Detecting Circuit". As well known, the self refresh mode is divided into active and stand-by states. The active and stand-by states of the self refresh mode have a constant interval, respectively. The interval is determined in the design of the chip. Accordingly, it is well known that the stand-by state of the self refresh mode is generated at a constant interval unlike that of the chip, and that the stand-by state thereof is longer maintained than the active state thereof (actually, the stand-by state occupies most self refresh mode). This is well known from the above paper or from data books of Samsung Co., Ltd. published 1992 and 1993. As mentioned above, during the stand-by state of the self refresh mode, the direct current flows into the ground terminal Vss from the power supply terminal Vcc in the substrate voltage level detector 10, thereby generating the current consumption. On the other hand, in case that the time when the semiconductor memory device is stayed in the stand-by state is similar to or is shorter than the operational period of the substrate bias generator, during the stand-by state, the substrate bias generator doesn't need to operate, however, only during the active state, it should operate. Thereby, the current consumption according to the substrate voltage is prevented from being increased during the stand-by state. However, since time of the stand-by state is not determined in the operation of the general semiconductor memory device, it is impossible to reduce the current consumption under the stand-by state according to the above method. In the self refresh mode to be refreshed by the period of the chip, since the time when the semiconductor memory device is stayed in the stand-by state and the active state is determined by the period generated in inside of the chip, it is possible to know the time when the semiconductor memory device is stayed in the stand-by state. Nevertheless, the current consumption generated in the chip is in total increased according to the current consumption generated from the substrate voltage level detector 10 during the stand-by state of the self refresh mode. It has been estimated that such increase of the current consumption can interfere with the suppression of the power consumption in the superhigh integrated semiconductor memory device having low power.

SUMMARY OF THE INVENTION

It is therefore object of the present invention to provide a substrate bias generator implementing a semiconductor memory device which consumes low power.

It is another object of the present invention to provide a substrate bias generator of a semiconductor memory device which minimally reduces current consumption during a self refresh mode.

It is still another object of the present invention to provide a substrate bias generator in which current consumption is prevented from being generated during a stand-by state of the self refresh mode.

It is further object of the present invention to provide a substrate bias generator capable of preventing inside of a substrate voltage level detector from generation of direct current during the stand-by state of the self refresh mode.

It is still further object of the present invention to provide a substrate bias generator capable of reducing current consumption of a semiconductor memory device by preventing inside of a substrate voltage level detector from generation of the direct current during the stand-by state of the self refresh mode.

It is yet object of the present invention to provide a substrate bias generator of a semiconductor memory device capable of reducing current consumption by stopping an substrate voltage detecting operation during the stand-by state, the semiconductor memory device having as an operational mode the self refresh mode which is divided into active and stand-by states.

The present invention according to the above objects is to provide a substrate bias generator to supply an negative voltage to a substrate of the semiconductor memory device having the self refresh mode.

The substrate bias generator according to the present invention has a substrate voltage level detector. As the substrate voltage level detector synchronizes with the period of the self refresh operation during the self refresh mode, the substrate voltage level detecting operation is enabled during the active state of the self refresh mode, whereas it is disabled during the stand-by state thereof.

The substrate voltage level detector according to the present invention comprises an input terminal for inputting an active signal of the self refresh mode and a switching device for controlling the substrate voltage level detecting operation of the substrate voltage level detector by being switch-controlled in response to an output level of the input terminal.

BRIEF DESCRIPTION OF THE DRAWINGS

The above and other objects, advantages and features of the present invention will be more apparent from the following detailed description taken with the attached drawings in which.

DETAILED DESCRIPTION OF THE PREFERRED EMBODIMENT

The point of the description of the preferred embodiment of the present invention is that a substrate bias generator is to prevent the consumption current generated during a stand-by state of a self refresh mode. Therefore, for convenience of the explanation, in the following description, a term "active state" is defined as that of the self refresh mode and another term "stand-by state" as that of the self refresh mode, except a determined case like an "active state of a chip" or a "stand-by state of the chip". Further, a signal ϕself of signals mentioned hereinafter indicates an enable signal and another signal ϕact thereof indicates an active signal of the self refresh mode.

Figure 1:
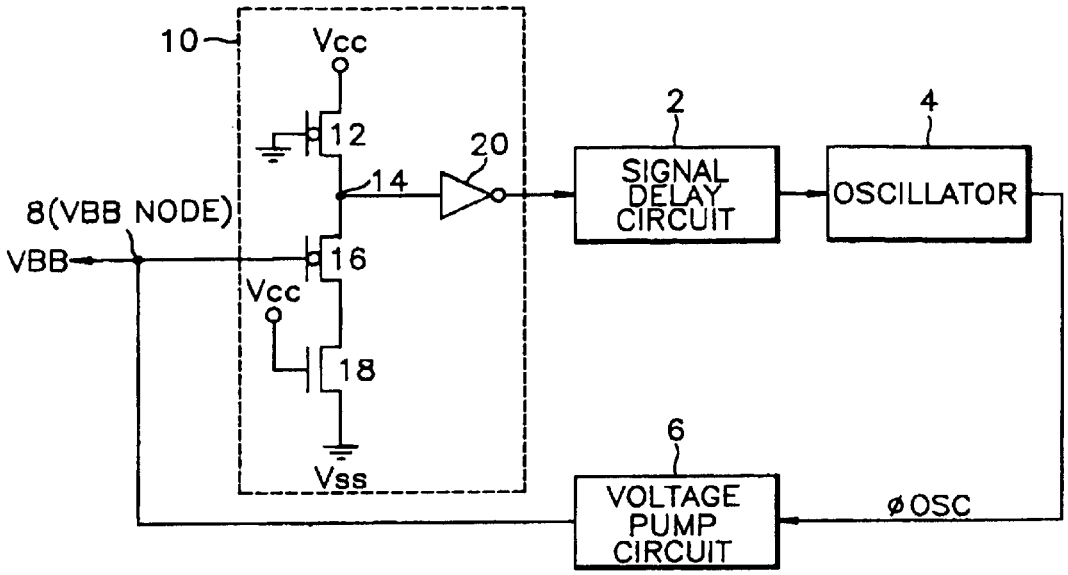
FIG. 1 (PRIOR ART)
FIG. 1 is a schematic block view of a substrate bias generator according to a conventional art.
Figure 2:
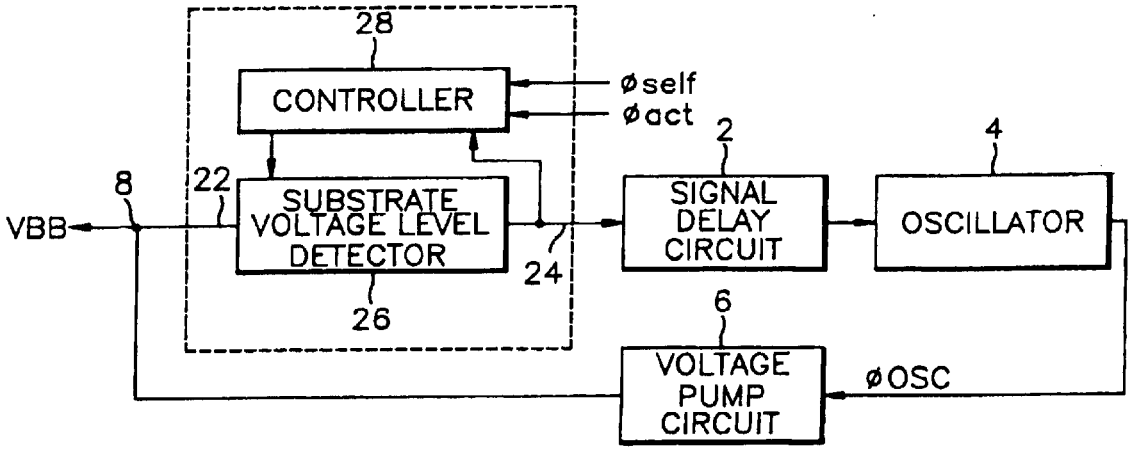
FIG. 2 is a schematic block view of a substrate bias generator according to the present invention.

FIG. 2 is a schematic block view of the substrate bias generator having a substrate voltage level detector according to the present invention. In the construction FIG. 2, a portion indicated by a dotted line block, is a new construction according to the present invention and is the subject matter of the present invention. Since the rest of portions except the dotted line block portion are the same as those of FIG. 1, their reference numerals are also the same as those of FIG. 1. In synchronization with the period of the self refresh operation, the detecting operation of the substrate voltage level detector 26 is enabled during the active state, whereas it is disabled during the stand-by state. Such a detecting operation is determined by the substrate voltage level detecting controller 28 which controls the substrate voltage level detector 26 by inputting in a feed-back manner the self refresh enable signal ϕself, the active signal ϕact of the self refresh mode and an output signal of the substrate voltage level detector 26. Accordingly, the driving capacity of the substrate voltage level detector 26 is determined according to the control of the controller 28 and will be in detail explained hereinafter.

In the meantime, in order to easily understand the present invention, the self refresh mode and the current consumption thereunder will be explained as follows. As well known in the art, the level of the substrate voltage VBB is raised by junction leakage current and substrate current caused by hot carrier generated when the transistors are operated. Therefore, in case that the semiconductor memory device is not operated and only power is provided, i.e., the stand-by state of the chip, there is scarcely the substrate current generated by the operation of the transistor and there remains only the junction leakage current. Thereby, the oscillator is operated during the stand-by state of the chip. If the semiconductor memory device is at the active state of the chip, many transistors are operated to generate a large amount of substrate current, so that the substrate voltage VBB is raised and the operating time of the substrate bias generator becomes long. Accordingly, during the stand-by state of the chip, the operational period of the substrate bias generator is determined depending upon the driving capacity of the voltage pumping circuit, i.e., depending upon how soon the substrate voltage VBB is charged up to the operational level of the oscillator by the junction leakage current and how soon it is dropped to the desired level. In the stand-by state of the chip, if the capacitance of the substrate voltage node becomes large and contrary that of the junction leakage current becomes small, the operational period of the substrate bias generator will become long. In the meantime, as mentioned above, if the time when the semiconductor memory device is stayed in the stand-by state of the chip is similar to or is shorter than the operational period of the substrate bias generator, during the stand-by state, the substrate bias generator doesn't need to operate, however, only during the active state, it should operate. Thereby, it is possible to prevent the current consumption under the stand-by state of the chip from being increased according to the substrate voltage. Accordingly, in the self refresh mode to be refreshed by the period of the chip, since the time when the semiconductor memory device is each stayed in the stand-by state and the active state of the chip is determined by the period generated in inside of the chip, it is possible to know the time when the semiconductor memory device is stayed in the stand-by state. Meantime, since the time of the stand-by state is several decades to hundreds of microsecond ($\mu$s) and is similar to or is shorter than the operational period of the substrate bias generator, as described above, it is possible to apply a method which reduces the current by intercepting the operation of the substrate bias generator during the stand-by state. Further, since the time of the stand-by state is longer than that of the active state in the self refresh mode, if the operation of the substrate bias generator is stopped, the current consumption can be largely reduced during the stand-by state.

Returning to FIG. 2, when the self refresh mode is enabled and the signal $\phi$act is disabled, the substrate voltage level detecting controller 28 prevents the driving operation of the substrate voltage level detector 26 to thereby intercept the generation of the direct current within the substrate level detector 26, the controller 28 in the feed back manner inputting the self refresh enable signal $\phi$self, the active signal $\phi$act of the self refresh mode and the output signal of the substrate voltage level detector 26. Further, if the active state begins in the self refresh mode cycle, the signal $\phi$act is enabled. Thereby, the driving operation of the substrate bias generator and the substrate voltage level detecting operation of the substrate voltage level detector 26 are performed. Then, the output signal of the substrate voltage level detector 26 operates continuously the substrate bias generator till the substrate voltage VBB is arrived at the desired level, even if the semiconductor memory device is stayed in the stand-by state by inputting the output signal thereof to the controller 28 in the feed back manner. According to such a series of operations, if the semiconductor memory device enters into the self refresh mode, the driving operation of the substrate voltage level detector 26 is stopped during the stand-by state and is only performed in the cycle of the active state. Thereby, the substrate bias generator is enabled only until the substrate voltage VBB is boosted to the desired level. In the total operational time of the self refresh mode, because the time when the substrate voltage level detector 26 is enabled is enough small to be ignored, components of the direct current are eliminated in the operational current of the self refresh mode, the components of the direct current being generated in the substrate voltage level detector 26.

Figure 3:
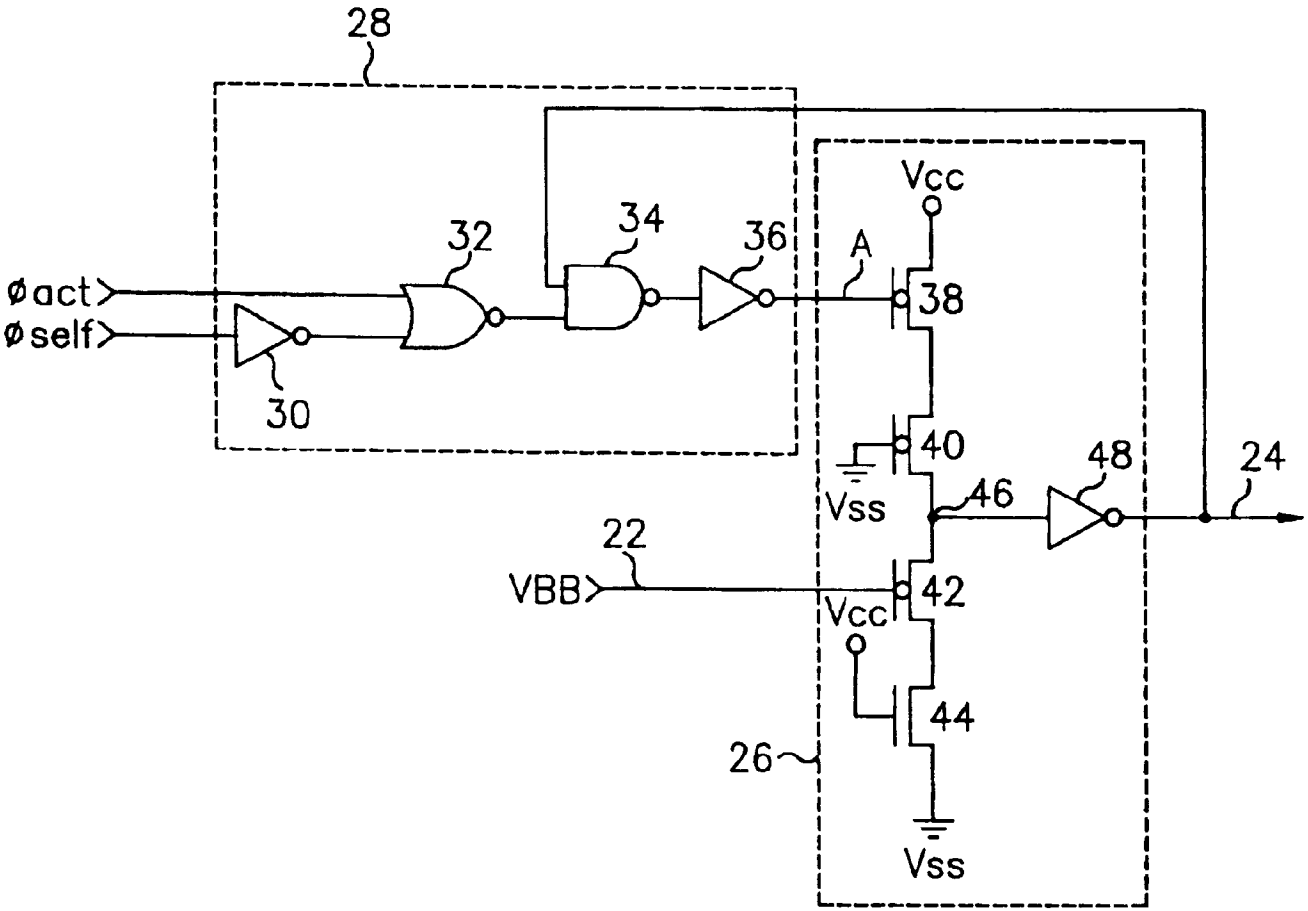
FIG. 3 is a detailed circuit view showing embodiments of a substrate voltage level detector 26 and its controller 28 according to the block construction of FIG. 2.

FIG. 3 is a detailed circuit view showing embodiments of the substrate voltage level detector 26 and its controller 28 according to the block construction of FIG. 2. In the construction of FIG. 3, the signal $\phi$self is generated according to conditions of inputs of a row address strobe signal $\overline{RAS}$ and a column address strobe signal $\overline{CAS}$, the row address strobe signal $\overline{RAS}$ and the column address strobe signal $\overline{CAS}$ being provided from the outside of the chip, i.e., the system. A process of generating the signal $\phi$self is disclosed in Korean Patent Application No. 93-13276 entitled "A Circuit for Controlling the period of a Self Refresh Operation" filed 24 Jul. 1993. As an active signal of the self refresh mode, the signal $\phi$act is generated in response to the inputs of the row address strobe signal $\overline{RAS}$ and the column address strobe signal $\overline{CAS}$. The controller 28 is comprised of a NOR gate 32 inputting the signals $\phi$self and $\phi$act through an inverter 30, a NAND gate 34 inputting an output signal of the substrate voltage level detector 26 and an output signal of the NOR gate 32, and an inverter 36 reversely outputting an output signal of the NAND gate 34. The substrate voltage level detector 26 is comprised of a PMOS transistor 38 whose source terminal is coupled to the power supply terminal Vcc and whose gate terminal is coupled to the output signal of the controller 28, a PMOS transistor 40 whose channel is formed between the PMOS transistor 44 and the connecting node 46 and whose gate terminal is coupled to the ground terminal Vss, a PMOS transistor 42 whose source terminal is coupled to the ground terminal Vss and whose gate terminal is coupled to the substrate voltage VBB, an NMOS transistor 40 whose channel is formed between the PMOS transistor 42 and the ground terminal Vss and whose gate terminal is coupled to the power supply terminal Vcc, and an inverter 48 having an input terminal coupled to the connecting node 46 and generating the output signal of the substrate voltage level detector 26.

Figure 4:
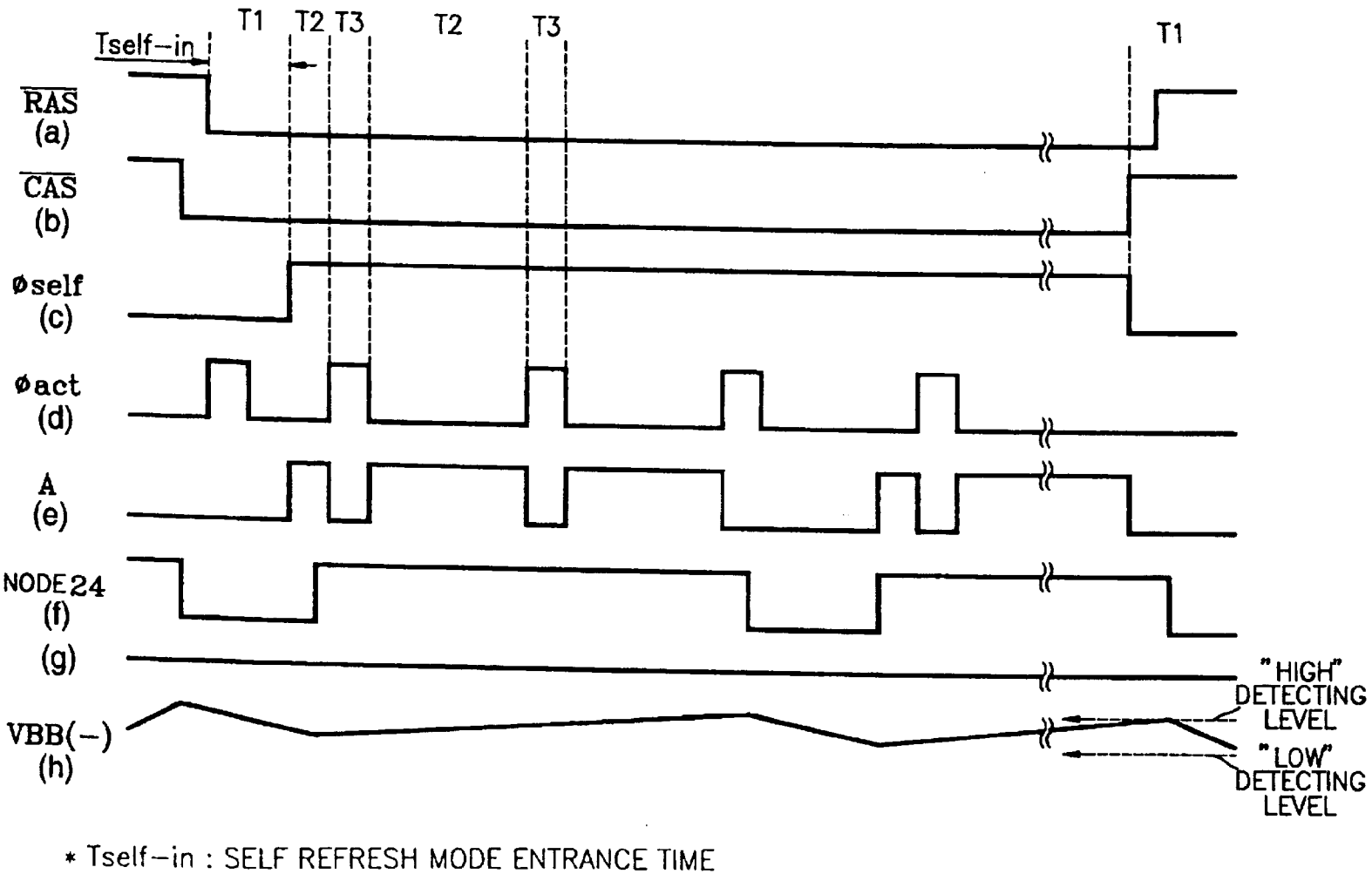
FIG. 4 is a timing diagram of each of signals of FIG. 3.

With reference to FIG. 4 being the operational timing diagram of FIG. 3, the operational characteristics of FIG. 3 will be explained hereinafter.

i) A state of a normal operation that the self refresh mode is not performed, is follows. The signals $\phi$self and $\phi$act are each at the "low" level, like an interval T1 of FIG. 4, for example, the stand-by slate of the normal operation. Therefore, the NOR gate 32 outputs the signal set to the "low" level by receiving the signal of the inverter 30 set to the "high" level. The NAND gate 34 is thus supplied with an output signal set to the "low" level and thereby outputs the signal set to the "high" level regardless of the voltage level of the node 24. The inverter 36 outputs the signal set to the "low" level by receiving the signal of the NAND gate 34 set to the "high" level. Accordingly, a control signal A of the PMOS transistor 38 becomes the "low" level, so that the substrate voltage level detector 26 is enabled to continuously perform the detecting operation of the substrate voltage VBB, the control signal A being an output signal of the inverter 36. In the meantime, in the substrate bias generator of FIG. 2, it is well known that the detecting operation of the substrate voltage level detector 26 is stopped when the substrate voltage VBB is boosted to the desired level.

ii) With reference to an interval T2 of FIG. 4, the stand-by state of the self refresh mode, i.e., the substrate voltage level detector does not perform the detecting operation, is as follows. As shown in FIG. 4, in case that the column address strobe signal $\overline{CAS}$ becomes active previous to the row address strobe signal $\overline{RAS}$ and is then input, if the self refresh mode entrance time $T_{self\text{-}in}$ goes by, the signal ϕself becomes the "high" level and another signal ϕact becomes the "low" level. Accordingly, the NOR gate 32 outputs the signal set to the "high" level by receiving the output signal of the inverter 30 set to the "low" level. Since the substrate voltage VBB is charged to the negative voltage level in the previous operation, the node 46 becomes the "low" level by the turning-on operation of the PMOS transistor 42 and the inverter 48 thus outputs the signal set to the "high" level. The NAND gate 34 outputs the signal set to the "low" level by receiving the signal of the NOR gate 32 set to the "high" level and the signal of the NAND gate 34 set to the "high" level, respectively. The inverter 36 outputs the signal set to the "high" level by receiving the signal of the NAND gate 34 set to the "low" level. Accordingly, the signal A becomes the "high" level and the PMOS transistor 38 is thus turned off. Thereby, the substrate voltage level detector 26 of FIG. 2 stops the detecting operation of the substrate voltage VBB. As shown in FIG. 4, the interval T2 of the stand-by state of FIG. 4 occupies most self refresh mode. Therefore, during the stand-by state of the self refresh mode, the operation of the substrate voltage level detector 26 is disabled, so that it is possible to reduce the current consumption.

iii) With reference to an interval T3 of FIG. 4, the active state of the self refresh mode is follows. The signal ϕself becomes the "high" level and also another signal ϕact becomes the "high" level. Thereby, the NOR gate 32 outputs the signal set to the "low" level by receiving the signal ϕact set to the "high" level. Then, the NAND gate 34 outputs the signal set to the "high" level regardless of the voltage level of the node 24 by receiving the signal of the NOR gate 32 set to the "low "level. The inverter 36 outputs the signal set to the "low" level by receiving the signal of the NAND gate 34 set to the "high" level. Thus, the signal A becomes the "low" level, so that the substrate voltage level detector 26 is enabled to continuously perform the detecting operation of the substrate voltage VBB.

The substrate voltage level detector 26 and its controller 28 of the substrate bias generator according to the present invention, as shown in FIG. 3, are the preferred embodiments based on the spirit of the present invention. However, it is well known to one skilled in the art that the constructions of the circuits can be differently embodied in connection with the logic of the self refresh enable signal ϕself and the chip active enable signal ϕact.

As mentioned above, the substrate bias generator according to the present invention inputs the output signal of the substrate voltage level detector and has the controller for controlling the switching operation of the substrate voltage level detector according to the input conditions of the self refresh enable signal ϕself and the active signal ϕact of the self refresh mode. Thereby, during the stand-by state of the self refresh mode, the generation of the direct current is prevented within the substrate voltage level detector and thus there arises an efficiency in that the current consumption can be reduced in the substrate bias generator.

What is claimed is:

1. A substrate bias generator of a semiconductor memory device having a voltage pump circuit to boost a substrate voltage in response to an input of an oscillating signal generated in an oscillator, said substrate bias generator further comprising:

a substrate voltage level detector having said substrate voltage input thereto and outputting a signal which drives said oscillator in response to a substrate voltage level detected by said substrate voltage level detector; and a controller having input thereto a chip active enable signal, a self refresh mode enable signal, and an output signal of said substrate voltage level detector, a self refresh mode of said semiconductor memory device having an active state and a standby state being defined by said chip active enable signal and said self refresh mode enable signal, said controller controlling a switching operation of said substrate voltage level detector in response to said substrate voltage level detected by said substrate voltage level detector, said controller also controlling said switching operation of said substrate voltage level detector in response to said chip active enable signal and said self refresh mode enable signal such that said substrate voltage level detector is not operative to drive said oscillator in said stand-by state of said self-refresh mode only when the detected substrate voltage level is a desired level.

2. A substrate bias generator of a semiconductor memory device having a voltage pump circuit to boost a substrate voltage in response to an input of an oscillating signal generated in an oscillator, said substrate bias generator further comprising:

a substrate voltage level detector having said substrate voltage input thereto and outputting a signal which drives said oscillator in response to a substrate voltage level detected by said substrate voltage level detector, said substrate voltage level detector comprising:

a first PMOS transistor whose source terminal is coupled to a power supply terminal and whose gate terminal is coupled to an output signal of a controller, first resistance means formed between said first PMOS transistor and a predetermined connecting node, a second PMOS transistor whose source terminal is coupled to said connecting node and whose gate terminal is coupled to said substrate voltage, second resistance means formed between said second PMOS transistor and a ground voltage terminal, and an inverter having an input terminal coupled to said connecting node and outputting an output signal of said substrate voltage level detector; and said controller having input thereto a chip active enable signal, a self refresh mode enable signal, and said output signal of said substrate voltage level detector, said controller controlling a switching operation of said substrate voltage level detector in response to said substrate voltage level detected by said substrate voltage level detector.

3. A substrate bias generator according to claim 2, wherein said controller comprises:

an inverter which inverts said self refresh enable signal;

a NOR circuit having input thereto said chip active enable signal and said inverted self refresh enable signal; and a NAND circuit having input thereto said output signal of said substrate voltage level detector and an output signal of said NOR circuit, said NAND circuit controlling said first PMOS transistor.

4. A substrate bias generator of a semiconductor memory device which performs refresh operations of memory cells according to a self refresh mode for refreshing said memory cells, said self refresh mode having an active state and a standby state defined by a chip active enable signal and a self refresh mode enable signal, said substrate bias generator comprising:

a voltage pump circuit to supply a negative voltage to a substrate;

an oscillator to drive said voltage pump circuit;

a substrate voltage level detector to detect a level of said negative voltage and to drive said oscillator in response to said detected level; and a controller circuit having input thereto said chip active enable signal, said self refresh mode enable signal, and an output of said substrate voltage level detector, an output of said controller circuit being input to said substrate voltage level detector, said output of said controller circuit being responsive to said chip active and said self refresh mode enable signals and said substrate voltage level detector output such that said substrate voltage level detector is not operative to drive said oscillator in said standby state of said self refresh mode only when the detected substrate voltage level is a desired level;

said substrate voltage level detector comprising:

a PMOS transistor having a gate coupled to said output of said controller circuit and having a source coupled to a power supply terminal, and a MOS transistor having a gate connected to said negative voltage, one source/drain terminal connected to a drain of said PMOS transistor and the other source/drain terminal connected to a ground supply, said MOS transistor being operated in response to a level of said negative voltage, said PMOS transistor selectively providing power to said MOS transistor in response to said output signal of said controller circuit.

5. A substrate bias generator as claimed in claim 4, wherein said first logic circuit is comprised of a NOR circuit.

6. A substrate bias generator according to claim 1, wherein said controller comprises:

an inverter which inverts said self refresh enable signal;

a NOR circuit having an input of said chip active enable signal and having input thereto said inverted self refresh enable signal; and a NAND circuit having input thereto said output signal of said substrate voltage level detector and an output signal of said NOR circuit, said NAND circuit controlling said first PMOS transistor.

7. A substrate bias generator according to claim 1, wherein said substrate voltage level detector includes:

a first MOS transistor having one source/drain terminal connected to a power supply, said first MOS transistor being operated in response to an output of said controller; and a second MOS transistor having one source/drain terminal connected to the other source/drain terminal of said first MOS transistor and the other source/drain terminal connected to a ground supply, and having a gate connected to said substrate voltage.

* * * * *